US006725569B2

(12) United States Patent
Turcotte et al.

(10) Patent No.: US 6,725,569 B2
(45) Date of Patent: Apr. 27, 2004

(54) DEVICE AND METHOD FOR VENTILATING AN OFFSET POCKET SPACE IN A PAPERMAKING MACHINE

(75) Inventors: Rémi Turcotte, Lery (CA); Dominique Thifault, Montreal (CA)

(73) Assignee: Enerquin Air Inc., Montreal (CA)

( * ) Notice: Subject to any disclaimer, the term of this patent is extended or adjusted under 35 U.S.C. 154(b) by 0 days.

(21) Appl. No.: 10/059,085

(22) Filed: Jan. 28, 2002

(65) Prior Publication Data

US 2002/0100186 A1 Aug. 1, 2002

Related U.S. Application Data

(63) Continuation-in-part of application No. 09/774,139, filed on Jan. 30, 2001, now Pat. No. 6,412,192.

(51) Int. Cl.[7] ..... F26B 13/06

(52) U.S. Cl. ..... 34/444; 34/618; 34/443; 34/454; 34/456; 34/457; 34/455; 34/463; 34/116

(58) Field of Search ..... 34/444, 457, 456, 34/420, 116, 419, 421, 422, 454, 455, 463, 611, 618, 240, 443

(56) References Cited

U.S. PATENT DOCUMENTS

| | | | |
|---|---|---|---|
| 3,110,575 | A | 11/1963 | Justus |
| 3,250,019 | A | 5/1966 | Beachler |
| 3,337,968 | A | 8/1967 | Krikorian et al. |
| 3,376,653 | A | 4/1968 | Daane |
| 3,384,973 | A | 5/1968 | Johansson |
| 3,388,479 | A | 6/1968 | Gardner |
| 4,172,007 | A | 10/1979 | Kankaanpaa |
| 4,416,070 | A | 11/1983 | Vedenpa et al. |
| 4,481,723 | A | 11/1984 | Vedenpaa |
| 4,485,567 | A | 12/1984 | Ely |
| 4,505,052 | A | 3/1985 | Osswald et al. |
| 4,516,330 | A | 5/1985 | Eskelinen et al. |
| 4,539,762 | A | 9/1985 | Eskelinen et al. |
| 4,602,439 | A | 7/1986 | Eskelinen et al. |
| 4,610,097 | A | 9/1986 | Kotitschke et al. |
| 4,625,434 | A | 12/1986 | Karlsson et al. |
| 4,669,198 | A | 6/1987 | Wedel |
| 4,694,587 | A | 9/1987 | Eskelinen |
| 4,881,327 | A | 11/1989 | Hauser et al. |
| 4,891,891 | A | 1/1990 | Wedel |
| 4,893,741 | A | 1/1990 | Heinzmann |
| 4,899,463 | A | 2/1990 | Heikkila et al. |
| 4,953,297 | A | 9/1990 | Eskelinen et al. |
| 5,019,213 | A | 5/1991 | Virta et al. |
| 5,044,094 | A | 9/1991 | Ilvespaa et al. |
| 5,044,095 | A | 9/1991 | Eivola |
| 5,086,571 | A | 2/1992 | Hietanen |
| 5,331,749 | A | 7/1994 | Thiele |
| 5,379,526 | A | 1/1995 | Haverinen |

(List continued on next page.)

*Primary Examiner*—K. B. Rinehart
(74) *Attorney, Agent, or Firm*—Timothy J. Keefer; Wildman, Harrold, Allen & Dixon LLP

(57) ABSTRACT

The device (10) and method are used for ventilating an offset pocket space (12) located in a drying section of a papermaking machine by injecting air from a heated dry air supply inlet (11). The offset pocket space (12) is situated between a set of three axially-parallel drying cylinders (20) over which consecutively runs a paper web (14). The device (10) comprises a first air outlet (50) where a first air stream is directed into a cleft (34) defined where the felt (16) rejoins the felt roll (26), and a second air outlet (52) where a second air stream is directed in close proximity to the felt (16) at a location which is upstream of the cleft (34). In use, the device (10) and the corresponding method allow the first air stream to flow through the felt (16) and lift the paper web (14) away from the felt (16) so as to reach the offset pocket space (12). The second air stream creates an air curtain to lower the pressure in a zone between the first (50) and the second air outlet (52).

7 Claims, 3 Drawing Sheets

U.S. PATENT DOCUMENTS 5,475,934 A 12/1995 Eskelinen et al.
5,477,624 A 12/1995 Haessner et al.
5,509,215 A 4/1996 Koiranen et al.
5,524,360 A 6/1996 Virta et al.
5,535,527 A 7/1996 Virta et al.
5,555,638 A 9/1996 Lehosvuo et al.
5,557,863 A 9/1996 Kokkala
5,560,123 A 10/1996 Eskelinen
5,628,124 A 5/1997 Skaugen et al.
5,661,911 A 9/1997 Yli-Kauppila
5,711,088 A 1/1998 Lindqvist et al.
5,720,109 A 2/1998 Yli-Kauppila
5,728,930 A 3/1998 Virta
5,775,001 A 7/1998 Kerttula et al.
5,792,318 A 8/1998 Mancini
5,860,223 A 1/1999 Kahl
5,864,965 A 2/1999 Hansson et al.
5,881,472 A 3/1999 Grunder et al.
5,887,358 A 3/1999 Bischel et al.
5,987,777 A 11/1999 Goebel et al.
5,996,244 A 12/1999 Saarikivi et al.
6,076,280 A 6/2000 Oechsle et al.
6,260,287 B1 7/2001 Walker et al.
6,412,192 B1 * 7/2002 Boucher et al. ..... 34/444

* cited by examiner

DEVICE AND METHOD FOR VENTILATING AN OFFSET POCKET SPACE IN A PAPERMAKING MACHINE

This is a continuation-in-part of U.S. patent application Ser. No. 09/774,139 filed on Jan. 30, 2001, now U.S. Pat, No. 6,412,192 which application is hereby incorporated by reference.

Papermaking is a sophisticated operation involving massive and very expensive machines. These machines are increasingly running at higher speeds, meaning that their overall efficiency must be very high, and in particular, the efficiency of their sub-components must also be very high. The papermaking process requires that water be removed from the initial pulp fiber solution as the paper is formed. The pulp fiber solution, once in the drying section of a papermaking machine, is referred to as the paper web. The paper web is supported as it travels across the machine following a path during which moisture is progressively removed therefrom. The support is provided by endless sheets of porous fabric, felts, wires or other water and gas permeable support means, all of which are generically referred to as the <<felt or felts>> in the description and appended claims.

The paper web travels from what is referred to as the wet end of the machine to the dry end thereof. In its path, the paper web runs over numerous heated drying cylinders where moisture is evacuated therefrom either by direct evaporation or transfer of moisture to the felts or to the surface of the drying cylinders. A network of ventilator devices is used throughout the drying section in order to inject heated dry air at numerous locations and promote the removal of moisture from the papermaking machine. At the dry end, the machine outputs the resulting paper, which is then generally reeled to be shipped elsewhere.

Papermaking machines can be built according to numerous possible configurations. One configuration in particular is the twin-wire draw, where the papermaking machine comprises two superposed rows of axially-parallel and horizontally-disposed heated drying cylinders. The paper web runs in a serpentine or zigzag path where it defines loops by alternating between the two rows of drying cylinders as it advances along the drying section. The paper web is being supported in most of its path with the assistance of the felts. There is generally one felt for each row of drying cylinders. Each felt presses the paper web on a portion of the surface of the drying cylinders of the corresponding row. Each felt also runs over a felt roll between each pair of adjacent drying cylinders of a same corresponding row. The felt rolls are located deep in the space between the two adjacent drying cylinders. This configuration allows to maintain the paper web in supporting contact with the felt as long as possible. The felt rolls essentially redirect a felt to the next drying cylinder of the same row.

It should be noted at this point that the terms <<roll or rolls>> and <<cylinder or cylinders>> are synonyms since both are elongated members with a circular cross-section, the only distinctions in the present context being that the drying cylinders are generally much larger in diameter than the felt rolls and are heated by appropriate means that are well known in the art. The segregated use of the terms in the text is only for the purpose of clarity. The <<cylinder or cylinders>> are sometimes referred to as <<drum or drums>> in other documents.

Traditional drying cylinders and felt roll arrangements feature the felt roll being positioned intermediate to the axis of rotation of adjacent drying cylinders, thus halfway between two adjacent drying cylinders. Inherent in these arrangements is the fact that the paper web is repetitively unsupported wherever the felt separates from the paper web to pass over a felt roll.

In order to increase the speed of papermaking machines, it was desirable to reduce the length of unsupported paper web because of the risks of rupture thereof, particularly near the wet end where the, paper web is weaker. One solution to this problem was to move the axis of rotation of the felt rolls backwards, more particularly towards the wet end of the machine, as illustrated in FIG. 1. This offset configuration has resulted in the felts and the paper web being in contact longer, thus minimizing the length of unsupported paper web as it travels from one drying cylinder to another.

The offset configuration of the felt rolls has also resulted in creating what is known as offset pocket spaces. In FIG. 1, the offset pocket spaces (12) are identified as hatched areas. Each offset pocket space (12) is situated between three successive drying cylinders (20) over which consecutively runs a paper web (14). There are thus many offset pockets (12) since there are many groups of three successive drying cylinders (20). A pocket space (12) may be roughly defined as the space limited by a felt (16) between two successive drying cylinders (20) of a same row, a first draw of paper web (14) from a first drying cylinder (20) to the next drying cylinder (20) of the other row, a second draw of paper web (14) between that second drying cylinder (20) and a third successive drying cylinder (20) on the same row as the first one, and the free surface of the second drying cylinder (20). The pocket spaces (12) are only open at each side of the machine. It should be noted that the pocket ventilators have been omitted from FIG. 1 to simplify the drawing.

Unfortunately, ventilating offset pocket spaces is more difficult than in symmetrical pockets spaces found in traditional configurations. This results from the reduction of the length of felt which does not support the paper web on the side upstream of the felt roll. Since the felt is permeable to air and the paper web is not, the conventional dry heated air ventilators which were hitherto provided cannot be used the same way since air cannot be blown through the felt when it is supporting the paper web. Moreover, an offset pocket space is often too small for receiving a ventilating device therein. All of this has resulted in decreased air flow into offset pocket spaces, thus a decrease in the efficiency of the ventilation.

An example of a pocket ventilator previously known in the art is disclosed in U.S. Pat. No. 5,074,278 to Turcotte and issued Dec. 24, 1991. It illustrates a traditional symmetrical arrangement of pocket spaces. This patent is hereby incorporated by reference.

The geometry of a pocket and the natural air currents generated in the pocket space by the moving paper web and felt, as well as the high rotation speeds of the drying cylinders and the felt rolls, are key factors which increase the difficulty in ventilating a pocket space. Air introduced in a pocket space has a natural tendency to follow the movement of the felt and also tends to be trapped in a cleft defined when the felt rejoins a drying cylinder. Such cleft, known as a closing nip, is a zone of positive air pressure where air tends to flow through the felt to evacuate the pocket space. Furthermore, a zone of negative air pressure is created in a cleft defined where the paper web leaves the felt roll on its way to the next drying cylinder. Some air evacuates the pocket space to satisfy the negative pressure created therein at the opening nip. However, these natural air currents do not provide an adequate ventilation of the pocket space as they do not effectively sweep of the pocket space. As a result, air becomes entrapped therein, thereby increasing the humidity level within the pocket space and decreasing the overall drying capacity of the papermaking machine.

The main object of the present invention is thus to provide a solution to the above-discussed ventilation problems so that offset pocket spaces of the drying section of a papermaking machine could be adequately ventilated.

The objects, features and advantages will be apparent from the following detailed description of a preferred embodiment thereof, which proceeds with reference to the accompanying figures in which.

Figure 3:
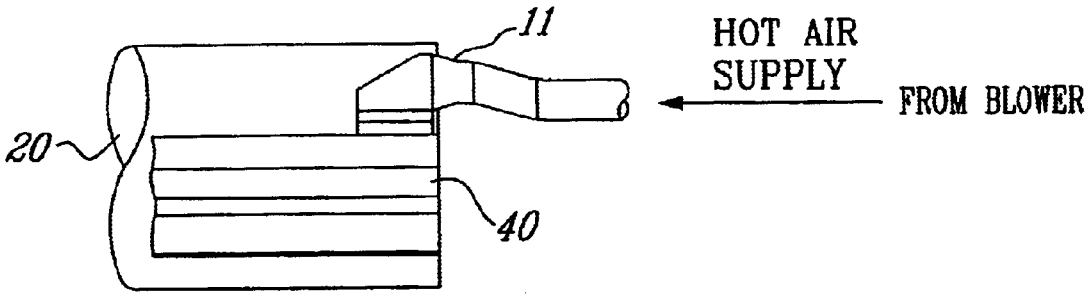
FIG. 3 is a schematic view of a portion of a cylinder and of the device, showing an example of how the device can be connected to an air supply inlet.

The device (10) is used for ventilating an offset pocket space (12) located in a drying section of a papermaking machine in which travels a paper web (14) to be dried. The device (10) essentially distributes heated dry air coming from a conventional air supply inlet (11), as schematically represented in FIG. 3. Air from the supply inlet (11) is preferably treated to remove as much moisture as possible and heated. Proper ventilation of the offset pocket spaces (12) is achieved by using the device (10) to inject the heated dry air in sufficient quantity so as to lower the humidity level and maximize water evaporation from the humid components, particularly the paper web (14). It should be noted that arrangements and constructions of the air supply inlet and related systems are well known to a person skilled in the art and do not need to be further described in detail.

Figure 1:
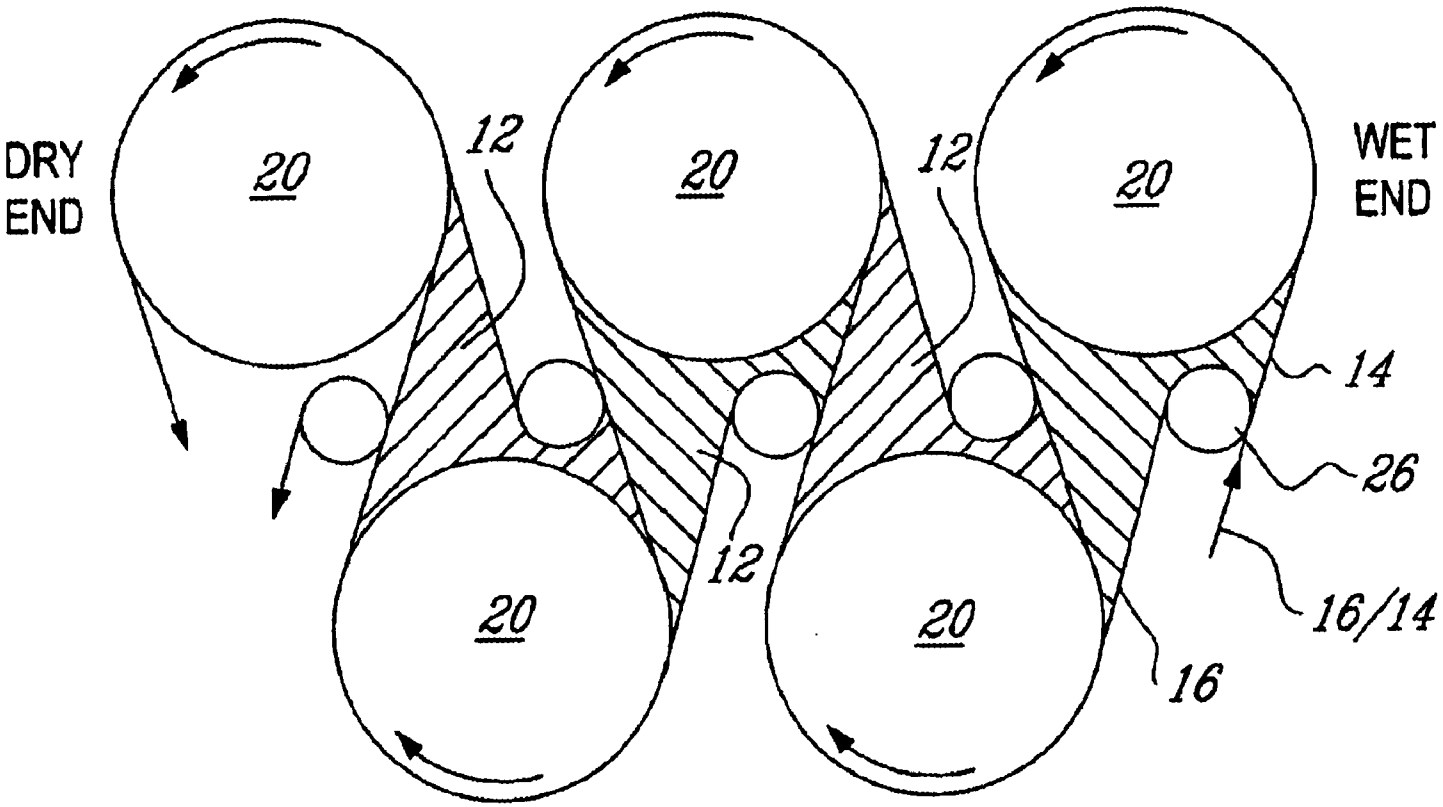
FIG. 1 ( PRIOR ART )
FIG. 1 is a schematic side view of a drying section of a papermaking machine as found in the prior art, illustrating an example of a twin-draw arrangement and the location of offset pocket spaces.

An offset pocket space (12) is situated between each group of three axially-parallel drying cylinders (20) over which consecutively runs the paper web (14). Among these cylinders (20), the first and third ones are vertically spaced from the second one, as shown in FIG. 1. This is due to the fact that there are usually two superposed rows of cylinders (20) in a papermaking machine, more particularly a lower row and an upper row. Since the paper web (14) follows a serpentine or zigzag path across the drying section, there is a plurality of successive pocket spaces (12) in a papermaking machine. The first and third cylinders (20) of a given group will be either on the lower or upper row, while the second cylinder (20) belongs to the opposite row.

As aforesaid, the paper web (14) is pressed against the corresponding first and third cylinders (20) by a felt (16) which further runs over a felt roll (26). The felt roll (26) has a rotation axis which is parallel to that of the cylinders (20). The felt roll (26) is disposed between the corresponding set of three cylinders (20) in an offset position, more particularly in a position which is closer to the first cylinder (20) than the third cylinder (20), as best shown in FIG. 1.

Figure 2:
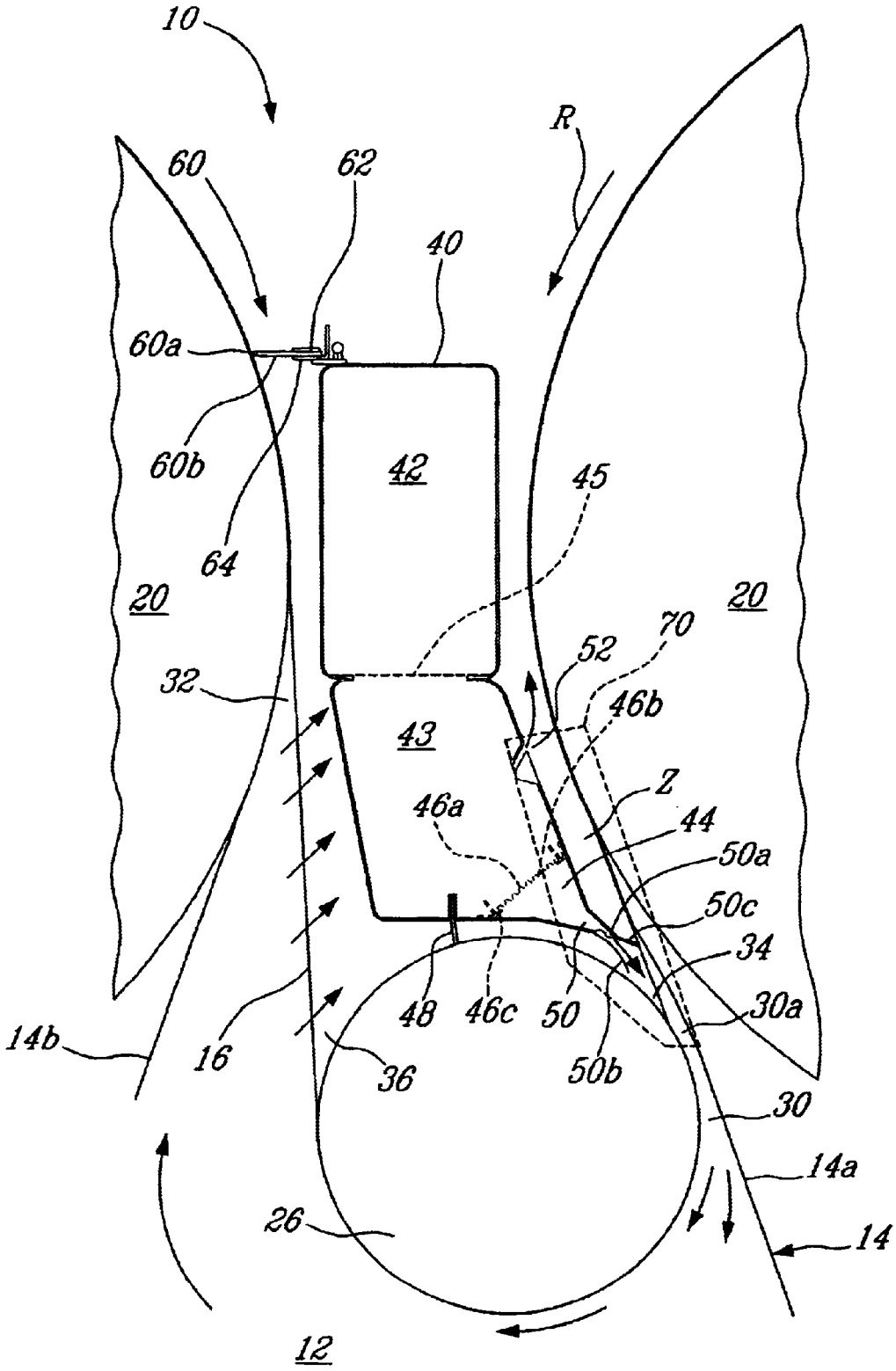
FIG. 2 is an enlarged side view of a device in accordance with a preferred embodiment.

Referring now to FIG. 2, the offset pocket space (12) is delimited by a first cleft (30) defined where the felt (16) and the paper web (14) separate, a first draw (14*a*) of the paper web (14) from the first cleft (30) to the second cylinder (20), a free portion of the second cylinder (20) where there is no paper web or felt, a second draw (14*b*) of the paper web (14) from the second cylinder (20) to a second cleft (32) defined where the felt (16) and the paper web (14) rejoin, and the felt (16) between the first cleft (30) and the second cleft (32).

The device (10) preferably comprises an elongated hollow body (40) extending parallel to and between the first and the third cylinder (20). It extends substantially along the entire length of the cylinders (20), more particularly from one side of the machine to another. The body (40) encloses at least one plenum chamber to distribute air to a first air outlet (50) and a second air outlet (52). In the preferred embodiment illustrated in FIG. 2, the body (40) comprises the three plenum chambers (42, 43, 44). The first (42) and second (43) plenum chambers are physically separated by an air diffuser, preferably consisting of a perforated plate (45). The main purpose of the perforated plate (45) is to distribute air uniformly across the second plenum chamber (43). Preferably, the second (43) and the third plenum chamber (44) are separated from each other by at least one perforated plate. In the illustrated embodiment, a set of three superposed perforated plates (46*a*, 46*b*, 46*c*) is provided, the plate (46*b*) in the middle being movable with reference to the others. This allows to adjust the flow of air by shifting the position of the movable plate (46*b*), thus moving its holes out of alignment with the corresponding holes of the other plates (46*a*, 46*c*). Other embodiments are possible as well.

The first air outlet (50) provides a first air stream which is directed into a third cleft (34). The third cleft (34) is defined where the felt (16) rejoins the felt roll (26). The second air outlet (52) provides a second air stream which is directed in close proximity to the felt (16) and at a location which is upstream of the third cleft (34). The second air stream is in a direction which is substantially opposite the running direction (R) of the felt (16). The first air stream is preferably ejected from the third plenum chamber (44) and the second air stream is preferably ejected directly from the second plenum chamber (43).

In the illustrated embodiment, the first air outlet (50) comprises a nozzle (50*a*) generally projecting towards the bottom of the third cleft (34). The nozzle (50*a*) longitudinally extends substantially along the entire length of the body (40), thus along the entire length of the cylinders (20). It should be noted that the term <<nozzle>> includes the case where the device (10) has a set of consecutive nozzles or similar structures that are closely spaced to one another.

The nozzle (50*a*) preferably comprises an outwardly-projecting lip (50*b*). At least a portion of the lip (50*b*), such as its free end, is curved towards the felt roll (26). The purpose of the lip (50*b*) is to orient the flow of ejected air so as to maximize the quantity of air flowing across the felt (16) and maximize the length where the paper web is supported by the felt (16). The lip (50*b*) also orients the flow of ejected air in a way which maximizes the vacuum in an upstream negative pressure zone (Z) created by the second air outlet (52), as explained hereinafter. A mechanical seal (50*c*) may also be used, on the opposite side of the nozzle (50*a*) with reference to the lip (50*b*), to minimize the flow of air from the first air outlet (50) entering the upstream zone (Z) and thereby reducing the vacuum therein. The mechanical seal (50*c*) projects towards the felt (16) from the edge of the nozzle (50*a*). The seal (50*c*) has a tip edge which is mechanical as close as possible to the felt (16).

The second air outlet (52) is preferably in the form of an elongated slot which is longitudinally extending on a side of the device (10) facing the first cylinder of a given group of three cylinders (20). The slot (52) extends substantially along the entire length of the body (40). It should be noted that the term <<slot>> also includes the case where the device (10) has a set of consecutive slots or similar structures that are closely spaced to one another. The second air stream creates an air curtain to lower the pressure in the zone (Z) between the first air outlet (50) and the second air outlet (52). The second air stream thus establishes a reduced air pressure in the zone (Z) at a location which is immediately upstream of the third cleft (34). This allows to maintain the paper web (14) on the felt (16) as long as possible after they leave the first cylinder (20) and to stabilize the paper web (14) so as to reduce the risks of fluttering.

As obvious to a person skilled in the art, the zone (Z) between the first air outlet (50) and the second air outlet (52), and also some surrounding areas, are closed on both sides of the papermaking machine by a corresponding mechanical seal (70). The mechanical seal (70) also covers the third cleft (34) to minimize the amount of air escaping from the sides. Of course, the exact shape of the mechanical seal (70) may differ from the one that is illustrated.

Advantageously, a mechanical seal (48) may be provided between the body (40) and the free portion of the felt roll (26). This prevents humid air coming from the offset pocket space (12) from following the surface of the felt roll (26) and therefore reentering the offset pocket space (12), thus lowering the efficiency of the ventilation.

In use, the above-described arrangement allows the first air stream to flow into the third cleft (34) and then through the felt (16). The air lifts the paper web (14) away from the felt (16) to reach the offset pocket space (12), creating an air cushion or <<bubble>> **(30*a*) curving the path of the paper web (14). This has been found to be a very effective way to ventilate the offset pocket space (12)**.

Since the parts are rotated or moved at very high speeds, the natural air pumping effect may be a concern, particularly in the center region of the papermaking machine. This pumping effect is due mainly to two phenomenons. The first is that air tends to follow the surface of the third cylinder of a given group of three cylinders (20). The second is that air is extracted from the offset pocket area space (12) into a fourth cleft (36) defined when the felt (16) and the felt roll (26) separate. In each case, the air flows out of the offset pocket space through the felt (16) between the fourth cleft (36) and the second cleft (32). A strong air pumping reduces the pressure in the pocket space (12), in spite of the first air stream which injects air therein.

Whenever air pumping is too important, it is possible to restrict air flow by creating an air flow restriction at a location on the third of the cylinders (20) over which the felt (16) runs, which location is immediately above the surface of the cylinder (20) and downstream of the second cleft (32). Accordingly, and as best shown in FIG. 2, the air flow restriction can be realized by an elongated mechanical seal (60) projecting from an outer portion of the body (40) towards a location on the third cylinder (20) where the felt runs thereon. The seal (60) does not necessarily extend over the entire length of the third cylinder (20) but needs at least to be placed where the pumping effect is the strongest. The seal (60) has a tip edge **(60*a*) in close proximity to the felt (16) and is only separated from the surface of the felt (16) by a small gap. The leading portion (60*b*) of the seal (60) is preferably made of a resilient material and preferably comprises means for adjusting the distance between the tip edge (60*a*) and the felt (16). These means may take many forms, as apparent to a person skilled in the art. One of them is to firmly hold the leading portion (60*b*) of the seal (60) between two rigid strips (62, 64) which can be loosened to shift the position of the leading portion (60*b*)**. Of course, other arrangements are possible, as apparent to a person skilled in the art.

Although a preferred embodiment of the invention has been described in detail herein and illustrated in the accompanying figures, it is to be understood that the invention is not limited to this precise embodiment and that various changes and modifications may be effected therein without departing from the scope or spirit of the present invention.

What is claimed is:

1. A method for ventilating an offset pocket space located in a drying section of a papermaking machine, the offset pocket space being situated between three axially-parallel drying cylinders over which consecutively runs a paper web, a first and a third of these cylinders being vertically spaced from a second of the cylinders, the paper web being pressed against the first and the third cylinder by a felt which further runs over a felt roll having a rotation axis parallel to that of the cylinders, the felt roll being disposed between the three cylinders in an offset position which is closer to the first cylinder than the third cylinder, the offset pocket space being delimited by a first cleft defined where the felt and the paper web separate, a first draw of the paper web from the first cleft to the second cylinder, a free portion of the second cylinder, a second draw of the paper web from the second cylinder to a second cleft defined where the felt and the paper web rejoin, and the felt between the first cleft and the second cleft, the method comprising:

directing a first air stream, at least partially following a curved path, from a first air outlet into a third cleft defined where the felt rejoins the felt roll, the first air stream flowing through the felt and lifting the paper web away from the felt to reach the offset pocket space;

directing a second air stream from a second air outlet in close proximity to the felt, the second air stream being supplied at a location which is upstream of the third cleft and in a direction which is substantially opposite the running direction of the felt so as to create an air curtain which lowers the pressure in a zone between the first and the second outlet, thereby maintaining the paper web on the felt for as long as possible;

restricting air coming from the offset pocket space from reentering the third cleft by flowing over a free portion of the felt roll; and restricting air coming from the first outlet from entering the lower pressure zone between the first and the second air outlet.

2. A method for ventilating an offset pocket space located in a drying section of a papermaking machine, the offset pocket space being situated between three axially-parallel drying cylinders over which consecutively runs a paper web, a first and a third of these cylinders being vertically spaced from a second of the cylinders, the paper web being pressed against the first and the third cylinder by a felt which further runs over a felt roll having a rotation axis parallel to that of the cylinders, the felt roll being disposed between the three cylinders in an offset position which is closer to the first cylinder than the third cylinder, the offset pocket space being delimited by a first cleft defined where the felt and the paper web separate, a first draw of the paper web from the first cleft to the second cylinder, a free portion of the second cylinder, a second draw of the paper web from the second cylinder to a second cleft defined where the felt and the paper web rejoin, and the felt between the first cleft and the second cleft, the method comprising:

directing a first air stream, at least partially following a curved path, from a first air outlet into a third cleft defined where the felt rejoins the felt roll, the first air stream flowing through the felt and lifting the paper web away from the felt to reach the offset pocket space;

directing a second air stream from a second air outlet in close proximity to the felt, the second air stream being supplied at a location which is upstream of the third cleft and in a direction which is substantially opposite the running direction of the felt so as to create an air curtain which lowers the pressure in a zone between the first and the second outlet, thereby maintaining the paper web on the felt for as long as possible;

restricting air coming from the offset pocket space from reentering the third cleft by flowing over a free portion of the felt roll; and restricting air flow through the felt between a fourth cleft, defined where the felt and the felt roll separate, and the second cleft.

3. A method according to claim 2, wherein restricting air flow through the felt comprises creating an air flow restriction above a location on the third cylinder where the felt runs thereon and which is immediately downstream of the second cleft.

4. A device for ventilating an offset pocket space located in a drying section of a papermaking machine by injecting air from at least one heated dry air supply, the offset pocket space being situated between three axially-parallel drying cylinders over which consecutively runs a paper web, a first and a third of these cylinders being vertically spaced from a second of the cylinders, the paper web being pressed against the first and the third cylinder by a felt which further runs over a felt roll having a rotation axis parallel to that of the cylinders, the felt roll being disposed between the three cylinders in an offset position which is closer to the first cylinder than the third cylinder, the offset pocket space being delimited by a first cleft defined where the felt and the paper web separate, a first draw of the paper web from the first cleft to the second cylinder, a free portion of the second cylinder, a second draw of the paper web from the second cylinder to a second cleft defined where the felt and the paper web rejoin, and the felt between the first cleft and the second cleft, the device comprising:

an elongated body extending parallel to and between the first and third cylinders, the body enclosing at least one plenum chamber;

a first air outlet from which a first air stream is directed into a third cleft defined where the felt rejoins the felt roll, the first air outlet being in fluid communication with the plenum chamber and comprising a nozzle having an at least partially curved lip outwardly projecting from a side of the nozzle adjacent to the felt roll;

a second air outlet where a second air stream is directed in close proximity to the felt at a location which is upstream of the third cleft, the second air stream being in a direction which is substantially opposite the running direction of the felt and being in fluid communication with the plenum chamber;

an elongated mechanical seal projecting from an outer portion of the body towards a location on the third cylinder where the felt runs thereon, the mechanical seal having a tip edge in close proximity to the felt; and means for adjusting the distance between the tip edge of the mechanical seal and the felt;

whereby, in use, the first air stream flows through the felt and lifts the paper web away from the felt to reach the offset pocket space, and the second air stream creates an air curtain to lower the pressure in a zone between the first and the second outlet so as to maintain the paper web on the felt for as long as possible.

5. A device according to claim 4, further comprising an elongated mechanical seal projecting from an outer portion of the body facing a free portion of the felt roll, the mechanical seal having a tip edge in close proximity to the free portion of the felt roll.

6. A device according to claim 4, further comprising a mechanical seal outwardly projecting towards the felt from a side of the nozzle opposite that of the lip, the mechanical seal having a tip edge in close proximity to the felt.

7. A device according to claim 4, wherein the device extends substantially along the entire length of the cylinders.

* * * * *